US006918157B2

(12) United States Patent
Koike

(10) Patent No.: US 6,918,157 B2
(45) Date of Patent: Jul. 19, 2005

(54) RAIL STRUCTURE FOR THE DOOR

(75) Inventor: Katsufumi Koike, Tokyo (JP)

(73) Assignee: Japan Automatic Door Co., Ltd., Tokyo (JP)

( * ) Notice: Subject to any disclaimer, the term of this patent is extended or adjusted under 35 U.S.C. 154(b) by 23 days.

(21) Appl. No.: 10/450,327

(22) PCT Filed: Nov. 21, 2001

(86) PCT No.: PCT/JP01/10158

§ 371 (c)(1),
(2), (4) Date: Jun. 9, 2003

(87) PCT Pub. No.: WO02/48492

PCT Pub. Date: Jun. 20, 2002

(65) Prior Publication Data

US 2004/0020613 A1 Feb. 5, 2004

(30) Foreign Application Priority Data

Dec. 14, 2000 (JP) ..... 2000-008827
Jan. 25, 2001 (JP) ..... 2001-016708

(51) Int. Cl.[7] ..... E05D 15/06

(52) U.S. Cl. ..... 16/94 R; 16/96 R; 16/97; 16/102

(58) Field of Search ..... 16/87 R, 94 R, 16/96 R, 97, 102, 107, 91, 95 R, 106; 104/93; 160/123, 124, 345–347

(56) References Cited

U.S. PATENT DOCUMENTS 949,826 A * 2/1910 Johnson ..... 16/105
2,141,145 A * 12/1938 Wooler et al. ..... 384/565
3,628,588 A * 12/1971 Dixon ..... 160/40
4,639,970 A * 2/1987 Adams ..... 16/90
4,785,494 A * 11/1988 Adamski ..... 16/95 R
4,800,618 A * 1/1989 Putz ..... 16/95 R
4,987,638 A * 1/1991 Ribaudo ..... 16/89
5,461,829 A * 10/1995 Lehto et al. ..... 49/409
6,021,839 A 2/2000 Knezevich et al.
6,125,506 A * 10/2000 Martin ..... 16/91
6,276,428 B1 * 8/2001 Pettersson et al. ..... 160/201

FOREIGN PATENT DOCUMENTS

| | | |
|---|---|---|
| DE | 19719011 | 11/1998 |
| EP | 0770752 | 9/1996 |
| JP | 2-9028 | 3/1990 |
| JP | 7-317419 | 12/1995 |
| JP | 9-317306 | 12/1997 |
| JP | 2000-230364 | 8/2000 |
| WO | WO96/04451 | 8/1994 |

OTHER PUBLICATIONS

Final Office actions, Japanese Patent Office, Japanese Patent Application No. 2001–016708, issued Mar. 9, 2004.
International Search Report, PCT/JP01/10158. issued Apr. 4, 2002.
Office action, Japanese Patent Office, Japanese Patent Application No. 2001–016708, issued Jul. 22, 2003.

* cited by examiner

*Primary Examiner*—Chuck Mah
*Assistant Examiner*—Michael J Kyle
(74) *Attorney, Agent, or Firm*—Kolisch Hartwell, P.C.

(57) ABSTRACT

A rail structure for doors comprises a track rail body (3) which supports the door wheels (4) which are attached to a door (6) and freely roll on the track rail body (3), a load support member (2) which is extended along the track rail body (3) and supports the track rail body (3) from the bottom side, a cushion member (7) which is disposed between the track rail body (3) and the load support member (2) and absorbs the vibration from the track rail body (3). A convexo-concave fitting part (8) which performs convexo-concave fitting is formed on the bottom surface of the track rail body (3) and on the upper surface of the load support member (2) via the cushion member (7). Purposes of the invention are to prevent vibrations caused by the running of the door wheels (4) from being transmitted to building, and to improve the efficiency of replacement operations for the track rail body (3), and to lower the cost.

5 Claims, 4 Drawing Sheets

RAIL STRUCTURE FOR THE DOOR

TECHNICAL FIELD

The present invention relates to a door rail structure for automatic doors and for other types of doors.

BACKGROUND ART

In conventional rails for doors, the track rail body on which the door wheels run and the load support member which attaches the rail body to a building are formed in a single piece, and these rails were installed in the buildings via this load support member by engaging devices such as bolts. These rails for doors are made of material which is harder than materials for wheels of the doors to avoid wear, and generally, extruded aluminum materials and steel materials are used.

However, regarding the above-mentioned conventional rails for doors, in the case that the track rail body which directly contacts the door wheels need be replaced, because the entire track rail including load support member must be replaced, there were disadvantages not only in that the replacement task became large-scaled, but also in that the cost for the replacement was also high.

There was also a disadvantage in that doors with this type of rail structure are not appropriate for use, particularly in wards where the quietude is required such as hospitals, residential areas, offices, etc., because vibrations made by the running of the door wheels are directly transmitted through to the building.

This invention was made in order to overcome these disadvantages, and objects of the inventions are to make replacing the track rail body more efficient and to lower the cost. In addition, an object of the invention is to avoid the vibrations made by the running door wheels being transmitted through to the building, etc.

DISCLOSURE OF INVENTION

In order to solve the above-mentioned problems, the rail structure for doors, according to the first aspect, has characteristics that the rail structure comprises a track rail body which supports wheels which art attached to doors so that the wheels can freely run, a load support member which extends along the above-mentioned track rail body and supports the track rail body from the bottom thereof, and track rail body is replaceably disposed on load support member. The present invention is described with respect to suspended doors, however, this does not exclude other types of doors. A load support member can be made of plural materials, or the entire part can be formed in a single piece as long as the load support member supports the track rail body and conveys the load to the building, etc. By constructing it in this way, it is possible to replace only the track rail body without replacing the load support member.

As explained above, by the invention according to the first aspect, by dividing the track rail into the track rail body and the load support member, and by replaceably attaching the track rail body to the load support member, because the replacement of only the track rail body becomes possible, the replacement of the load support member becomes unnecessary, the replacing operation of the track rail body in the case in which it is worn becomes easy, and the cost for replacement is decreased. Furthermore, by separating the load support member and the track rail body, both can respectively be made of different materials, and it is possible to choose a suitable material for each function.

Also, the rail structure for doors, according to the second aspect, has characteristics that a convexo-concave fitting part is formed on the bottom surface of the track rail body and on the upper surface of the load support member. The concave part is formed on either side on the track rail body or on the load support member, and the convex part is formed on the other side.

By constructing it in this way, easy assembly and easy replacement of the track rail body is possible.

By the invention according to the second aspect, in addition to the effect of the first aspect, because the connection of the load support member and the track rail body is made by the fitting device, the assembly and the replacement of the track rail body can be easily performed.

Also, the rail structure for doors, according to the third aspect, has characteristics that cushion member which absorbs vibrations from the track rail, is disposed between the track rail body and the load support member. By constructing it in this way, even if vibrations occur when the door wheels run on the track rail body, the vibrations are not transmitted to the building side via the load support member, or are decreased because the vibrations are absorbed by the cushion member.

By the invention according to the third aspect, in addition to the effects of the first and the second aspects, by putting the cushion member between the track rail body and the load support member, even if the wheels of the door run on the track rail and vibrations occur on the track rail body or vibrations are transmitted to the track rail body, because the cushion member absorbs the vibration, the vibration is not transmitted to the building side via the load support member or the vibration decreases.

Also, the rail structure for doors, according to the fourth aspect, has characteristics that the convex part which extends along the continuing direction of the track rail body on either of the bottom surface of the track rail body or the upper surface of the load support member, the groove-shaped concave part which extends along the continuing direction of the track rail body is formed on the other surface, thus the convexo-concave fitting part is formed, an interface of surfaces, in addition to the convexo-concave fitting part, is formed which are facing each other between the bottom surface of the track rail body and the upper surface of the load support member, and the cushion member is put between the track rail body and the load support member, respectively in the convexo-concave fitting part and the interface of surfaces. The convex part and the concave part, however, extend in the continuing direction of the track rail, they do not necessarily continuously extend over the entire length of the track rail. That is, there can be one or plural parts in which the convex part and the concave part are discontinuous within the entire length of the track rail. By constructing it in this way, it is possible to make the load support member fully support the load of the door via the cushion member, and it is possible to increase the damping of vibrations between the load support member and the track rail body.

By the invention according to the fourth aspect, in addition to the effect of the first through the third aspects, by putting the cushion member in the interface of surfaces rather than in the convexo-concave fitting part of the load support member and the track rail body, the load support member can fully support the load of the door via these cushion members, and the effect of damping vibrations between the load support member and the track rail body can further be enhanced.

Also, the rail structure for doors, according to the fifth aspect, has characteristics that, of the concave part, the width dimension B of the middle part in the depth direction of a groove is larger than the width dimension A of the margin of a groove, and the side face of the groove is made to form a circular section, while the convex part is made to form a section corresponding to the concave part, the width dimension C of the middle part in the height direction is larger than the width dimension D of a neck part, the side face of the convex part forms a circular section, the width dimension C is smaller than the width dimension A, the cushion member which is made of elastically deformable board-shaped material, and the thickness dimension E is larger than half the dimension of the difference between the width dimension A and the width dimension C. The cushion member is put in the convexo-concave fitting part formed by the concave part and the convex part, so the fact that the cushion member is elastic so that its thickness is smaller than the half the dimension of the difference between the width dimension A and the width dimension C, is inferable from the fact that the cushion member is put between the track rail body and the load support member in the convexo-concave fitting part according to the fourth aspect. By constructing it in this way, at the time of the fitting of the convexo-concave fitting part between the track rail body and the load support member, the disconnection of the track rail body from the load support member is avoided thanks to the retention of the convex part inside the concave part by elastic deformation of the cushion member and the snap action which is accompanied by the recovery of the elastic deformation.

By the invention according to the fifth aspect, in addition to the effect of the first through the fourth aspects, by specifying the dimension of width of the margin of the concave part in the convexo-concave fitting part and the maximum dimension of width of the middle part of the height direction of the convex part, at the time of fitting of the convexo-concave fitting part, because the convex part is retained in the concave part by the elastic deformation with the snap action accompanied by its recovery, the derailing of the track rail from the load support member is prevented.

Also, the rail structure for doors, according to the sixth aspect, has characteristics that, the thickness dimension E of the cushion member is made to be equal to or larger than half the dimension of the difference between the width dimension B and the width dimension C. By constructing it in this way, the convex part makes no movement inside the concave part of the convexo-concave fitting part, because the convex part is retained closely in the concave part, the load support member and the track rail body can be securely attached.

By the invention according to the sixth aspect, in addition to the effect of the first through the fifth aspects, by arranging the thickness of the cushion member to be equal to or larger than the thickness of the dimension of the gap between the convex part and the concave part, the convex part makes no movement inside the concave part, and thus, the convex part is closely retained, so that the load support member and the track rail body are securely assembled.

Also, the rail structure for doors according to the seventh aspect, has characteristics that, the convex part which extends along the continuing direction of the track rail body is formed on the upper surface of the track rail body, and the concave part which is engaged with the convex part on the upper surface of the track rail body, on the outer surface of the wheels. By constructing it in this way, the derailing of the door wheels from the track rail body can be avoided. Also, backward leaning in the continuing direction of the track rail body can be restricted.

Also, the rail structure for doors, according to the eighth aspect, has characteristics that, the concave part which extends along the continuing direction of the track rail is formed on the upper surface of the track rail, and the convex part which is engaged with the concave part on the upper surface of the track rail body, on the outer surface of the wheels. By constructing it in this way, the derailing of the door wheels from the track rail body can be avoided.

By the invention according to the eighth aspects, by forming the concave part and the convex part, both of which are engaged with each other on the upper surface of the track rail body and the outer surface of the wheels of the door, the derailing of the wheels from the track rail body can be prevented. Particularly in the invention according to the seventh aspect, because the convex part is formed on the upper surface of the track rail body, the leaning backward of the track rail toward the continuing direction can be restricted.

Also, the rail structure for doors, according to the ninth aspect, has characteristics that, either the track rail body or the wheel is made of material with greater hardness than the other. By constructing it in this way, it is possible to specify the part made of material with greater hardness between the track rail body and the wheels as the material for less frequent replacement.

By the invention according to the ninth aspect, in addition to the effect of the first through the eighth aspects, by constructing either the track rail body or the wheels from a material having greater hardness than the other, the member having greater hardness, i.e., either the track rail body or the wheels, can be specified as that for less frequent replacement.

BEST MODE OF CARRYING OUT THE INVENTION

Preferred embodiments of the rail structure according to the present invention will be explained with reference to FIGS. 1 through 4.

First Embodiment

Figure 1:
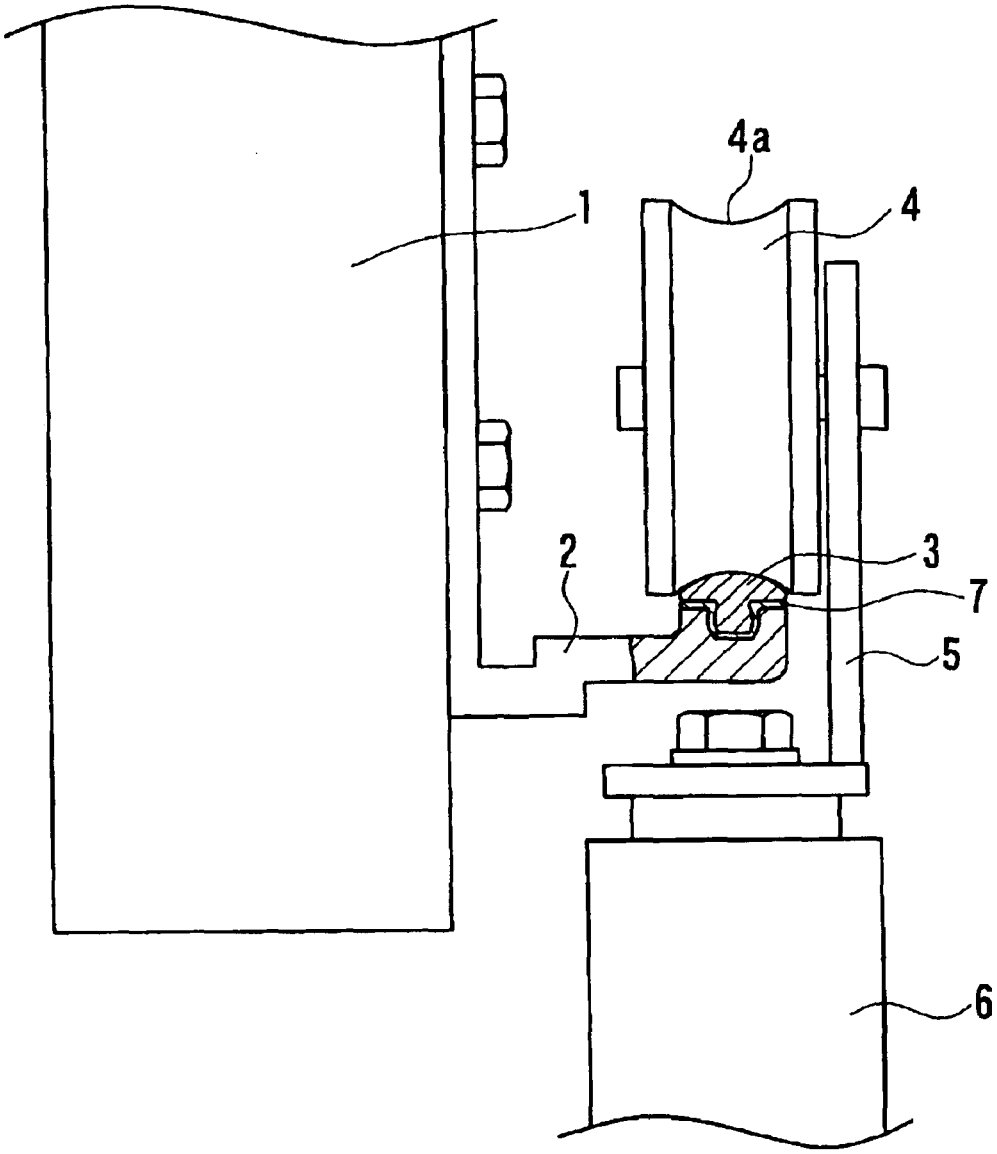
FIG. 1 is a cross section illustrating a first embodiment of the door rail structure according to the present invention.

First preferred embodiment of the rail structure according to the present invention will be explained with reference to FIG. 1 and FIG. 2. FIG. 1 shows the state in which load support member 2 is installed on member of building side 1, the track rail body 3 is fit to this load support member 2, door wheels 4 are engaged onto the upper surface of this track rail body 3, door wheels 4 freely roll on the upper surface of this track rail body 3, and the door 6 is suspended from the door wheels 4 via brackets 5. Plural door wheels 4 are engaged with the track rail body 3 in the longitudinal direction of the track rail body 3, and door 6 is suspended from the track rail body 3 by these door wheels 4, and door 6 freely runs on the track rail body 3.

Figure 2:
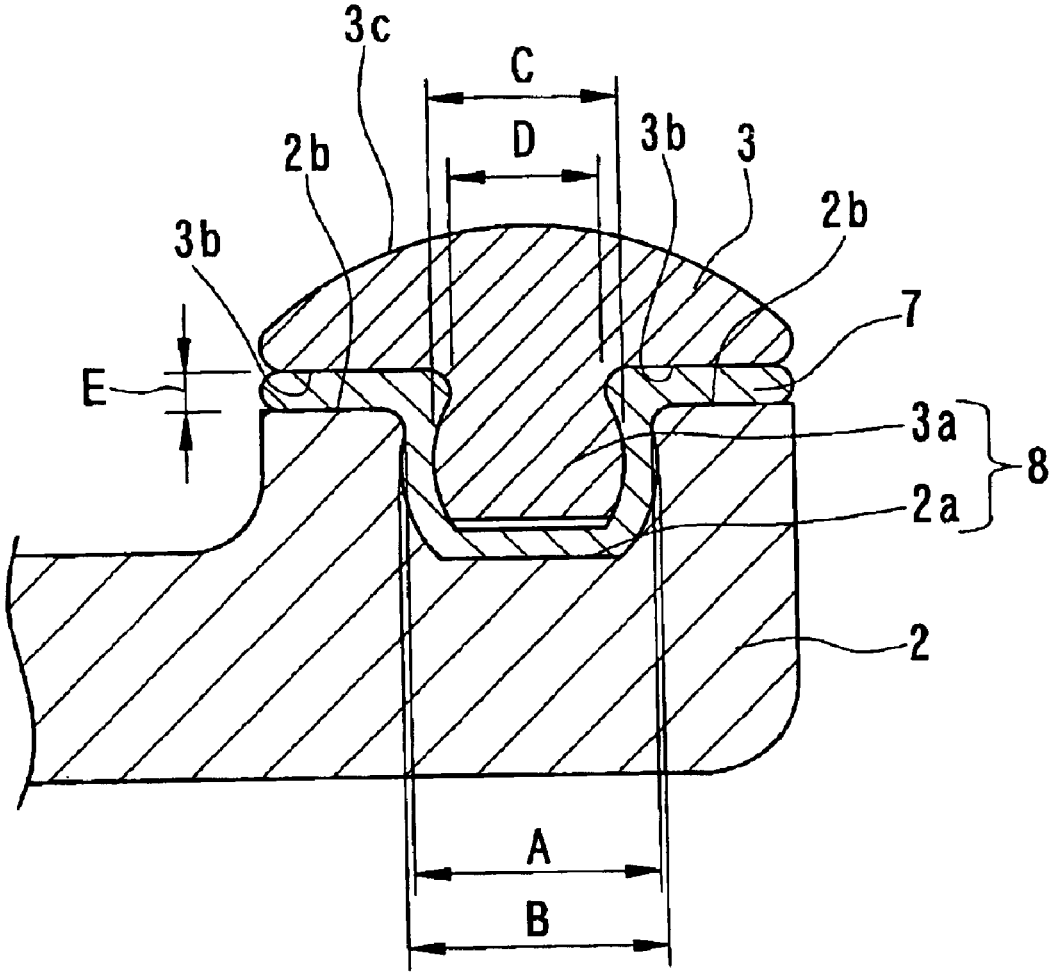
FIG. 2 is a partial enlarged cross section of the first embodiment.

FIG. 2 is a partial enlarged cross section of FIG. 1, wherein cushion member 7 is placed between the load support member 2 and the track rail body 3. The cushion member 7 is a board-shaped material having an elastic component such as silicone rubber, ester type polyurethane, ether type polyurethane, natural rubber, chloroprene rubber, neoprene rubber, vinyl acetate, and isobutylene-isoprene rubber, and the cushion member 7 is formed so as to have a cross section as shown in FIG. 2.

Although the load support member 2 is made of extruded aluminum material, the load support member 2 can be made of other metals or synthetic resins, for example, acrylic resin, vinyl chloride, etc. Also, although the load support member 2 is made in a single piece of member, the load support member 2 can be made by connecting plural parts. Regarding this load support member 2, on the upper surface on which the track rail body 3 is carried, along the continuing direction of the track rail body 3, the concave part 2*a* is formed to be groove-shaped, and on both sides of this concave part 2*a*, a flat part 2*b* is formed. This concave part 2*a* has a shape such that the width of the middle part in the depth direction is expanded. That is, the margin of the concave part 2*a*, in other words, the width dimension B of the middle part in the depth direction of the groove is larger than the width dimension A of both sides of the open top mouth part of the groove which comprises the concave part 2*a*, and side surface of the groove is in a circular section of concave shape.

Also, although the track rail body 3 is made of extruded aluminum material, the track rail body 3 can also be made of other metals, for example various steel materials such as austenite stainless steel material, martensitic stainless steel material, flat-rolled steel material, carbon steel material as well as copper alloys, etc or synthetic resins. On the bottom surface of the track rail body 3, a convex part 3*a* which extends along the continuing direction of the track rail body 3 is formed, and a flat part 3*b* is formed on both sides of this convex part 3*a*. The convexo-concave fitting part 8 is formed by the concave part 2*a* of the load support member 2 and the convex part 3*a* of the track rail body 3. The cross sectional shape of the convex part 3*a* is corresponding to the concave part 2*a*, of which the width dimension C of the middle part of the height direction is larger than the width dimension D of the neck part located in an upper position, the side face of the convex part 3*a* is in the form of a convex circular section. Furthermore, the width dimension C is smaller than the width dimension A, and between the concave part 2*a* and the convex part 3*a*, a gap space with generally uniform thickness in cross section is formed.

Also, the upper surface of the track rail body 3 is the convex part 3*c* which protrudes to the upper side in circular cross section, and this convex part 3*c* extends in the continuing direction of the track rail body 3. This convex part 3*c* keeps the track rail body 3 from leaning backward in the continuing direction of the track rail body 3.

The thickness dimension E of the cushion member 7 is larger than half the dimension of the difference between the width dimension A and the width dimension C; therefore, the cushion member 7 is accompanied with compressive deformation at the time of the insertion of the convex part 3*a* into the concave part 2*a*. Also, because the thickness dimension E of the cushion member 7 is equal to or larger than half the dimension of the difference between the width dimension B and the width dimension C, the cushion member 7 in the compressed state is filled, with no gap, between the concave part 2*a* and the convex part 3*a* when the convex part 3*a* is fit to the concave part 2*a*.

The cushion member 7 is formed with a cross sectional shape like that of "Ω" in advance as shown in FIG. 2. This cross sectional shape is made corresponding to the shape of the gap formed between the fitted concave part 2*a* of the load support member 2 and the convex part 3*a* of the track rail body 3. Then, before attaching the track rail body 3 to the load support member 2, the cushion member 7 is previously attached on the track rail body 3. In order to attach the cushion member 7 on the track rail body 3, it is only necessary that the cushion member 7 with the "Ω"-shaped section be fitted outside of the convex part 3*a* of the track rail body 3. Because the cushion member 7 is elastically deformable, this cushion member 7 is fitted to the convex part 3*a* with a round shape in cross section with a slight elastic deformation.

Next, the track rail body 3 is attached to the load support member 2 by fitting the convex part 3*a* to the load support member 2, while the cushion member 7 is fitted outside of the convex part 3*a*. At this time, because the dimension E of the cushion member 7 is larger than half the dimension of the difference between the width dimension A and the width dimension C, the convex part 3*a* is fitted in the concave part 2*a* while a part of the cushion member 7 is compressed. In the state that the convex part 3*a* is inserted inside the concave part 2*a*, the compression of the cushion member 7 is released, and the thickness of the cushion member 7 recovers until it is equal to the thickness of the gap between the convex part 3*a* and the concave part 2*a*, thus the convex part 3*a* is retained inside the concave part 2*a*. In this manner, by the snap action by the elastic deformation of the cushion member 7, the convex part 3*a* is inserted into the concave part 2*a* and this state is maintained. Therefore, the track rail body 3 does not easily disconnects from the load support member 2.

The door wheels 4 of the door 6 are made of deformable material, which is less hard than the track rail body 3, that is, they are made of soft resin material, for example, polyamide resin, polyacetal resin, ABS resin, polycarbonate resin, phenol resin, MC nylon, etc. In this way, because the track rail body 3 is made of material which is harder than the door wheels 4, it is possible for the track rail body 3 to suffer less wear than the door wheels 4, and the replacement of the track rail body 3 can be less frequent than the replacement of the door wheels 4.

However, the track rail body 3 is not necessarily free from being abraded, and the track rail body 3 may become worn after being used for a long time. Also, the track rail body 3 may sometimes break due to one cause or another, even without it being worn. In such a case, the track rail body 3 and the cushion member 7 can be detached from the load support member 2, and the track rail body 3 can be replaced. In this case, because the load support member 2 and the track rail body 3 are connected by the fitting of the concave part 2*a* and the convex part 3*a*, with the cushion member 7 in between the concave part 2*a* and the convex part 3*a*, the operations of attaching and detaching the track rail body 3 become easy, and replacement can be easily performed. Also, because the load support member 2 need not be replaced, the replacing operation becomes easy and the cost for replacement decreases.

Also, the concave part 4*a* which is formed in circular cross section is formed on all around the outer surface of the door wheels 4. This concave part 4*a* is formed corresponding to the convex part 3*c* on the upper surface of the track rail body 3, and the door wheels 4 roll and move while the door wheels 4 make the concave part 4*a* engage with this convex part 3*c*. By the engagement of the concave part 4*a* and the convex part 3*c*, the derailing of the door wheels 4 from the track rail body 3 is prevented.

In the rail structure for doors which is constructed as above, the cushion member 7 is positioned between the upper surface of the load support member 2 and the bottom surface of the track rail body 3, and thus the load support member 2 and the track rail body 3 are insulated from vibrations by the cushion member 7. Accordingly, even though the door wheels 4 of the door 6 run on the track rail body 3 and vibrations occur or are transmitted to the track rail body 3, because the cushion member 7 absorbs the vibrations, the vibrations are not transmitted to the member of building side 1 via the load support member 2, or the vibrations are damped.

Second Embodiment

Figure 3:
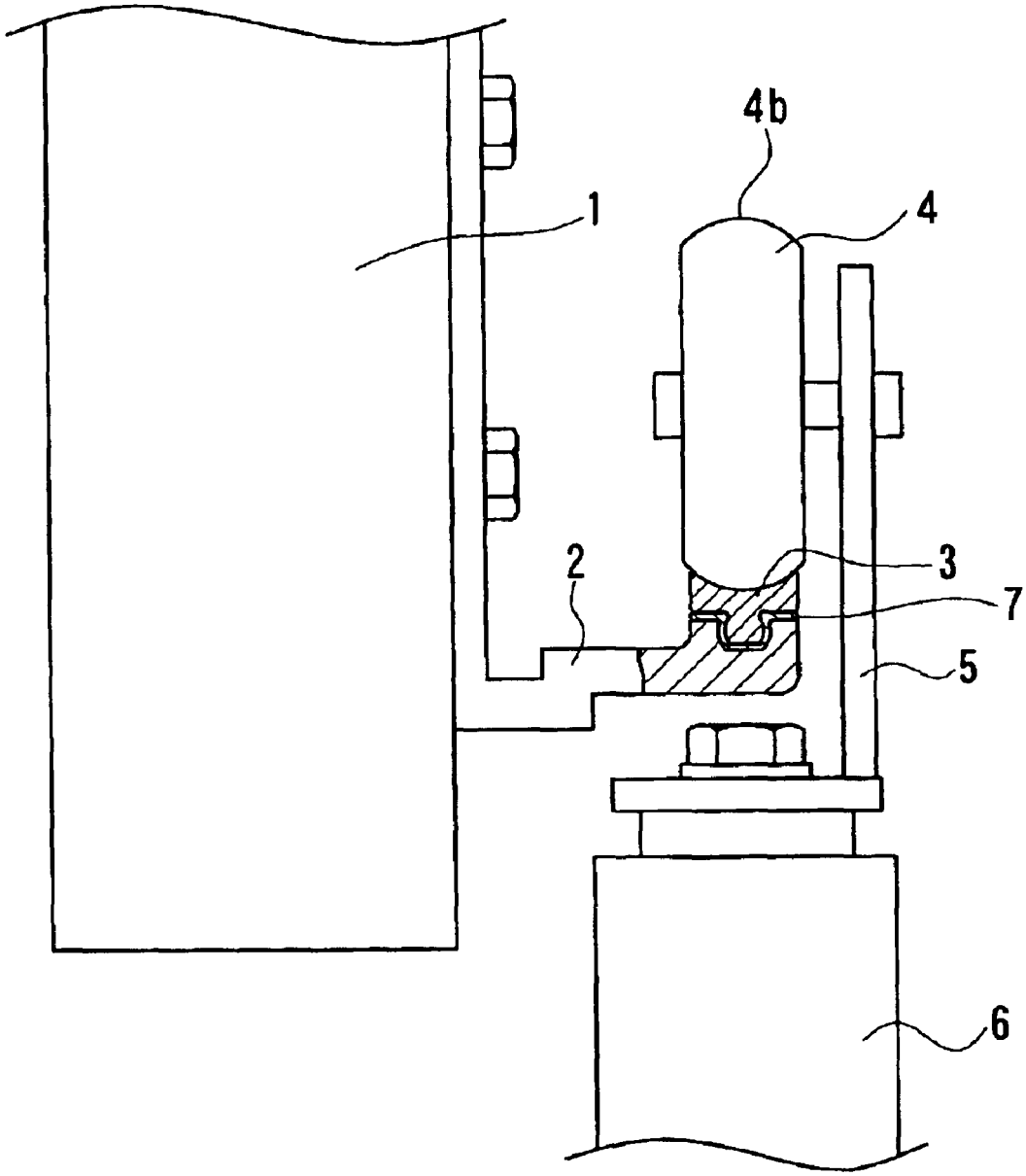
FIG. 3 is a cross section illustrating a second embodiment of the door rail structure according to the present invention.
Figure 4:
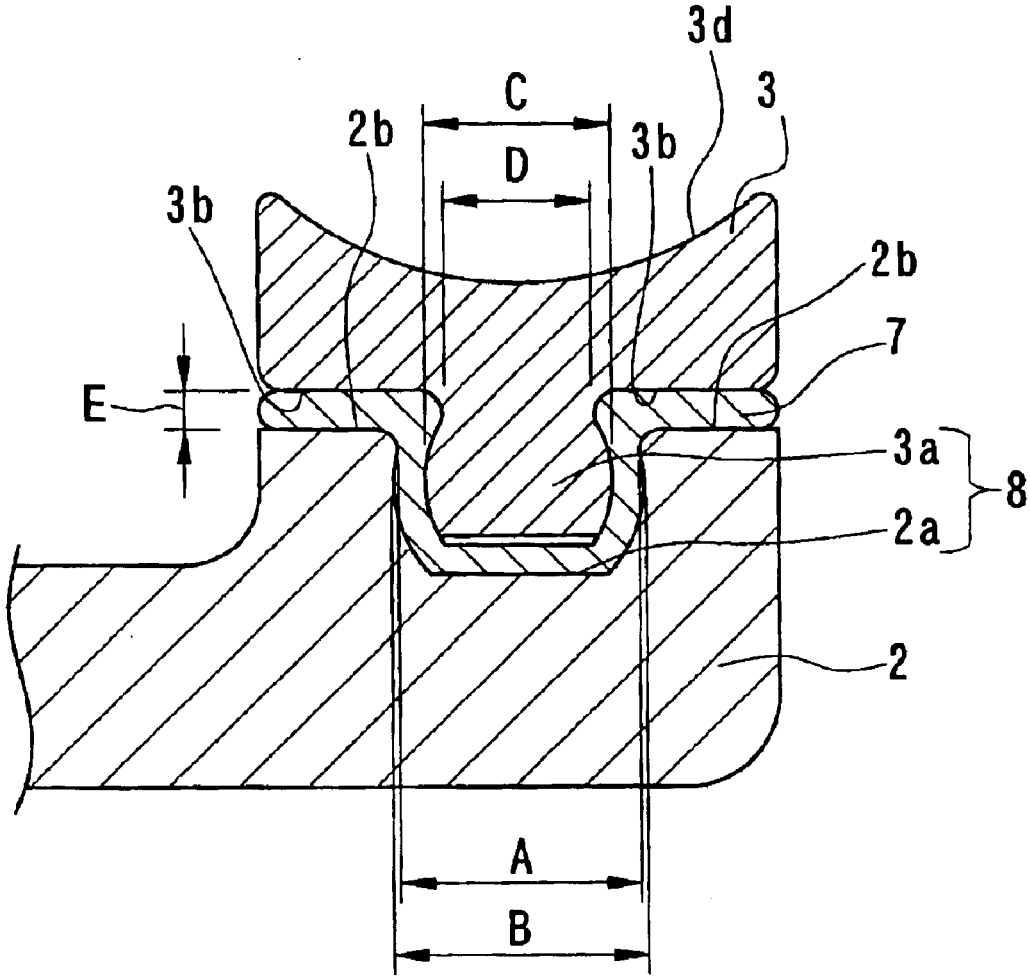
FIG. 4 is a partial enlarged cross section of the second embodiment.

Next, the second preferred embodiment of the rail structure for doors according to the present invention will be explained with reference to the drawings FIG. 3 and FIG. 4. The fact that the rail structure of the second preferred embodiment differs from that of the first preferred embodiment is only in the shape of the wheels and the shape of the track rail body; other structures and the relationships of the dimensions of each part are the same as in the first preferred embodiment, and therefore, identical reference numerals are attached to the identical parts, and the explanation thereof is omitted.

The convexo-concave shape of an engaged part of the door wheels 4 of the door 6 and the track rail body 3 in the second preferred embodiment is in opposite relationship to the convexo-concave shape of the engaged part in the first preferred embodiment. To explain in more detail, while in the first preferred embodiment, the upper surface of the track rail body 3 is made to be a circular section of the convex part 3*c*, and the outer surface of the door wheels 4 of the door 6 is made to be a circular cross section of the concave part 4*a*, in the second preferred embodiment, the upper surface of the track rail body 3 is a circular section of the concave part 3*d*, this concave part 3*d* extends in the continuing direction of the track rail body 3, and the convex part 4*b* which is in a circular cross section is formed on all around the outer surface of the door wheels 4.

Additionally, this convex part 4*b* is formed corresponding to the concave part 3*d* of the upper surface of the track rail body 3, and the door wheels 4 roll and move while engaging the convex part 4*b* with this concave part 3*d*. Also, in the second preferred embodiment, the derailing of the door wheels 4 from the track rail body 3 is prevented by the engagement of the convex part 4*b* and the concave part 3*d*.

Also, in the rail structure for doors in this second preferred embodiment, the same operational effects can be achieved as in the case of the first preferred embodiment.

Other Preferred Embodiments

The present invention is not limited to the embodiments described above. For example, in each embodiment described above, regarding the convexo-concave fitting part 8 of the track rail body 3 and the load support member 2, the convex part 3*a* is formed on the track rail body 3, and the concave part 2*a* is formed on the load support member 2, and thus the convexo-concave fitting part 8 is constructed; it is also possible for the convexo-concave fitting part to be constructed by forming the concave part on the track rail body 3, and at the same time, forming the convex part on the load support member 2.

Also, in each embodiment described above, although it is explained that the dimension E of width of the cushion member 7 is generally of uniform thickness, it is also acceptable for the thickness between the flat part 2*b* of the upper surface of the load support member 2 and the flat part 3*b* of the bottom surface of the track rail body 3 to be different from the thickness in the convexo-concave fitting part 8. In this case, the explanation of the thickness dimension E of the cushion member 7 in this invention and the embodiments described above shall be understood to be the dimension of the thickness in the convexo-concave fitting part 8.

Also, in each embodiment described previously, it is possible for the track rail body 3 to be made of a material having greater hardness than the door wheels 4 of the door 6, and the door wheels 4 are therefore replaced more frequently than the track rail body 3 is replaced so that the door wheels 4 will be the item to wear out first. Conversely, the door wheels 4 may be made of a material having greater hardness than the track rail body 3, and the track rail body 3 is replaced more frequently than the door wheels 4 are replaced so that the track rail body 3 will be the item to wear out first.

Also, in each embodiment described previously, although the cushion member 7 is placed between the load support member 2 and the track rail body 3, the invention will still be effective even if the cushion member 7 does not exist. In that case, although the effect of decreased vibration cannot be achieved by the cushion member 7, the effect that only the track rail body 3 can be replaced is possible.

INDUSTRIAL APPLICABILITY

In the present invention, by dividing the track rail into the track rail body and the load support member, and by replaceably attaching the track rail body to the load support member, because the replacement of only the track rail body becomes possible, the replacement of the load support member becomes unnecessary, the replacing operation of the track rail body in the case in which it is worn becomes easy, and the cost for replacement is decreased. Furthermore, by separating the load support member and the track rail body, both can respectively be made of different materials, and it is possible to choose a suitable material for each function.

What is claimed is:

1. A rail structure for doors, comprising:

a track rail body (3) which supports door wheels (4) which are attached to a door (6) such that the door wheels (4) freely run on the track rail body (3);

a load support member (2) extending alone the track rail body (3) and supporting the track rail body (3) from the bottom thereof;

a convexo-concave fitting part (8) which is formed on a bottom surface of the track rail body (3) and an upper surface of the load support member (2), the convexo-concave fitting part (8) fitting in the state of convexo-concave fitting; and a cushion member (7) for absorbing vibration from the track rail body (3), the cushion member (7) being disposed between the track rail body (3) and the load support member (2), wherein the track rail body (3) is attached to the load support member (2) detachably, the convexo-concave fitting part (8) includes a convex part (3*a*) and a concave part (2*a*) such that the convex part (3*a*) which extends along the continuing direction of the track rail body (3) is formed on either side between the bottom surface of the track rail body (3) and the upper surface of the load support member (2), and in such a way that the concave part (2*a*) which is groove-shaped and extends along the continuing direction of the track rail body (3) is formed on the other side between the bottom surface of the track rail body (3) and the upper surface of the load support member (2), an interface of surfaces which face each other in addition to the convexo-concave fitting part (8) is formed on the bottom surface of the track rail body (3) and on the upper surface of the load support member (2), the cushion member (7) is put in the convexo-concave fitting part (8) and the interface of surfaces between the track rail body (3) and the load support member (2), a width dimension B of a middle part of a depth direction of the groove of the concave part **(2*a*) is larger than a width dimension A of margin of the groove, a side face of the groove is in the form of circular section in the state of concave shape, the convex part (3*a*) is in the sectional shape corresponding to the concave part (2*a*), a width dimension C of the middle part of a height direction of the convex part (3*a*) is larger than a width dimension D of a neck part, the side face of the convex part (3*a*) is in the form of circular section in the state of convex shape, the width dimension C is smaller than the width dimension A, a thickness dimension E of the cushion member (7) is larger than half a difference between the width dimension A and the width dimension C, and the cushion member (7)** is board-shaped, elastically deformable material.

2. The rail structure for doors, according to claim 1, wherein a thickness dimension E of the cushion member (7) is equal to or larger than half a difference between the width dimension B and the width dimension C.

3. The rail structure for doors, according to claim 1, wherein a curved convex surface **(3*c*) which extends along the continuing direction of the track rail body is formed on an upper surface of the track rail body (3), and a curved concave surface (4*a*) which is engaged with the curved convex surface (3*c*) on the upper surface of the track rail body (3) is formed on the outer surface of the wheels (4)**.

4. The rail structure for doors, according to claim 1, wherein a curved concave surface **(3*d*) which extends along the continuing direction of the track rail body (3) is formed on an upper surface of the track rail body (3), and a curved convex surface (4*b*) which is engaged with the curved concave surface (3*d*) on an upper surface of the track rail body (3) is formed on the outer surface of the door wheels (4)**.

5. The rail structure for doors, according to claim 1, wherein either said track rail body (3) or the door wheels (4) is made of a material having a greater hardness than that of the other.

* * * * *